US005927036A

United States Patent [19]

Matthews et al.

[11] Patent Number: 5,927,036

[45] Date of Patent: Jul. 27, 1999

[54] FLOOR JOIST SYSTEM

[75] Inventors: LeRoy Matthews, Hawthorn Woods; Paul R. Vrechek, Barrington, both of Ill.

[73] Assignee: Perf-X-Dek, L.L.C., Fort Wayne, Iowa

[21] Appl. No.: 08/884,717

[22] Filed: Jun. 30, 1997

[51] Int. Cl.[6] ..... E04B 2/30

[52] U.S. Cl. ..... 52/483.1; 52/262; 52/263; 52/664; 52/737.1; 52/737.2; 52/634; 52/638; 52/690; 52/694; 52/696

[58] Field of Search ..... 52/483.1, 664, 52/665, 660, 729.1, 729.2, 737.1, 262, 263, 271, 264, 634, 690, 693, 694, 696, 638, 223.8, 250, 668, 737.2

[56] References Cited

U.S. PATENT DOCUMENTS

| | | | |
|---|---|---|---|
| 3,050,831 | 8/1962 | Diamond | 52/729.1 X |
| 3,283,464 | 11/1966 | Litzka | 52/729.1 X |
| 4,794,745 | 1/1989 | Platt et al. | 52/664 X |
| 5,517,796 | 5/1996 | Koski et al. | 52/664 X |

*Primary Examiner*—Carl D. Friedman
*Assistant Examiner*—W. Glenn Edwards

[57] ABSTRACT

A floor joist system for building construction comprising interconnected steel girders and joists. The girders may be castellated I beams having a plurality of large openings and regularly spaced vertical slots through its web, which extend between opposite side walls of a building or its foundation, supported thereby. Joists may be I beams of shorter height than the girders which have tongues formed from their webs which extend from their ends. The tongues of two joists are fitted into a single vertical girder slot from opposite sides of the girder, their tongues overlapping therein. The opposite ends of the joists are similarly fitted into an adjacent girder or rest upon a side wall of the building or its foundation. The girder slot is positioned and the side walls are adapted such that the uppermost surfaces of the joists and the girder(s) are coplanar. The overlapping tongues of the joists may have two pairs of vertically aligned and substantially superimposed holes, one pair located on each side of the girder web. A compliant metal pin may be received through each aligned pair of holes, interconnecting the joists and the girder, and bent such as to maintain its position. A subfloor is attached to the uppermost surfaces of the joists and the girder(s).

17 Claims, 4 Drawing Sheets

FLOOR JOIST SYSTEM

BACKGROUND OF THE INVENTION

1. Field of Invention

The invention relates generally to building construction and more particularly to floor joist systems used in building construction, especially residential construction.

2. Background Art

Floor joists used in residential and some smaller commercial building construction are typically made of wooden 2 inch by 10 inch planks or beams of engineered wood having an I shaped cross section with a 2 inch wide flange and a 10 inch height which extend longitudinally between opposite side walls of a house or its foundation, resting on the top surfaces thereof, providing support for the floor of each individual building story. In residential construction, the subfloor adjacent the joists is usually ¾ inch thick plywood. Generally, wooden joists are limited in their length or span to about 14 or 16 feet, at which point they must be supported from beneath, usually by an intermediate load bearing wall or a girder (or header) extending in directions perpendicular to the joists, the girder itself perhaps partially supported by a support post or column and/or the side walls between which the girder extends. The girder may be comprised of a plurality of 2 inch by 12 inch planks disposed side by side to provide additional thickness or may be an engineered wood beam or steel I beam. Other types of joists and/or girders used in larger commercial buildings, which often have poured concrete floors, include steel or iron I beams which have integrated flanges and webs or which are assembled from components, as disclosed in U.S. Pat. Nos. 669,639 (Hessel et al.), 4,151,694 (Sriberg et al.) and 3,800,490 (Conte). Concrete floors and metal joist systems are not generally used for residential construction due to the higher costs involved and their not being readily adapted to conventional housing designs.

A plurality of parallel floor joists laid out across the area bounded by the supporting side walls provides a series of generally coplanar surfaces to which the subfloor is attached, usually by adhesives and nails or screws. The attachment of the subfloor to the topmost surfaces of the joists prevents the joists from moving, although it is common to provide braces therebetween to stabilize them. The joists and girders are oriented so as to expose their maximum bending moments against the loading of the above floor; this normally entails setting the joists on the side walls in an upright manner upon one of their shorter rectangular sides or their I beam flanges, the opposite short rectangular side or I beam flange abutting the lower surface of the supported floor. A pocket or recess provided in the girder bearing side wall provides a surface upon which the girder rests, the surface disposed a distance below the top of the side wall somewhat equivalent to the height of the girder. This arrangement allows the bottom most surface of the joist to rest on the top surface of the side wall and the girder. Disposing the girder as such and disposing the joists thereupon, however, compromises the ceiling height of the below room at least partially or otherwise forces the floor of the above room to be higher. Furthermore, the below room ceiling height may be further compromised, at least locally, by pipes, wiring or ventilation ducts routed below the girder.

Joists are usually transversely spaced in a parallel fashion at fixed distance from each other in accordance with the weight bearing characteristics of the materials used and the designed building load requirements. Typically, in residential construction, wooden joists of either the plank or engineering beam variety are spaced 16 inches on center. Wooden plank and engineered wood floor joists are maintained in their upright positions, i.e., kept from falling over, and spacing relative to one another by lateral braces which do not interface the lower surface of the floor or support or help distribute its weight. Steel I beam type floor joists such as used in commercial building construction may likewise be maintained in position by braces interconnected with the webs thereof, although the wide bottom flange of most steel I beams is sufficient to prevent its inadvertently falling over.

Wooden floor joists of the plank or engineered beam variety are generally limited to 14 or 16 foot spans between supports and 16 inch on center spacing relative to one another, requiring many joists and supporting girders be provided in a house of conventional size and design, thus comprising an appreciable portion of the cost of required building material, particularly if the more expensive engineered wood beams are used. As a further result, plank or engineered wood beam floor joist systems are rather expensive in terms of labor because of the quantity of joists required to be installed. Moreover, wooden plank joists may be irregular, undesirably having crowns or cupping, sagging or bowing. Often, significant effort and cost are required to correct these conditions during construction or their effects after the building is completed. Engineered wood beam joists resolve many of these issues, but are rather more expensive than plank joists and have no appreciably greater load bearing capability.

Wooden planks, as lumber, are considered to be commodities, and thus their cost is greatly influenced by fluctuating market prices, which can make estimating future building costs more difficult. Engineered wood beams, comprised to a great extent of wood chips and more labor intensive to produce, are not so readily influenced, although they are generally more expensive.

There is a need for a floor joist system which is relatively stronger and less labor intensive than previous systems employing wooden plank or engineered wood beam joists, provides a consistently flat flooring surface, more efficiently uses vertical space and is not greatly influenced by commodity market price fluctuations.

SUMMARY OF THE INVENTION

The present invention provides a floor joist system preferably made of commercially available heavy gauge steel and having girders and interconnected joists which may have an I shaped cross section. The I beam girders are preferably castellated, providing a high bending moment and large web openings, and have vertical slots formed in their web sections. The girders extend between opposing side walls of a building or the foundation thereof, the ends of the girders supported by the side walls. Much stronger than wooden plank or engineered wood beam girders of comparable height, castellated beam girders may span greater distances without requiring intermediate underlying support between outside walls, thus requiring relatively fewer intermediate support columns. In accordance with the present invention, steel I beam joists having tongues formed and extending from the web sections thereof are disposed perpendicularly and equidistantly along each side of a girder, the tongues of each equidistant pair of joists extending into a common vertical slot formed in the girder web and overlapping each other therein. These overlapping pairs of tongues may be interconnected using compliant pins on each side of the girder web or otherwise retained in overlapping relation to each other to maintain their position during assembly of the floor joist system. The interconnection of joists and cross beams continues in this manner to provide a complete floor joist system across the area to be floored. The subfloor is secured to the upper surface of the upper girder and joist flanges by, for example, adhesives and/or drill point screws.

The I beam joists of the present invention provide much greater bending resistance than wooden plank or engineered wood beam joists, and thus may be longer and spaced farther apart. In conventional residential construction of a given design using a ¾ inch subfloor, 8 inch tall I beam joists of the present invention may span 20 feet between the side wall and/or the girders and be spaced 24 inches on center, compared to 14 to 16 foot spans and 16 inch on center spacing required of wooden 2 inch by 10 inch plank joists or 10 inch tall engineered wood beams. The joists of the present invention may be spaced 32 inches on center where a less common ⅞ inch thick subfloor is used. Moreover, the I beam joists of the present invention do not exhibit irregularities such as crowns, cupping, sagging or bowing, as are common in wooden plank joists and which often require time consuming correction during construction or may cause undesirable related effects thereafter.

The steel joists and girders of the inventive floor joist system may be made completely of recyclable material and are themselves completely recyclable. Furthermore, the joists and girders of the present invention will not support a flame, providing a further advantage over wooden floor joist systems.

The girders and joists of the present invention have coplanar upper flange surfaces, thus the load of the floor is directly supported along two directions rather than only one, thereby providing a firmer floor with its weight better distributed among its supporting members. A further advantage of the inventive floor joist system is that the height of the joist is contained within the height required for the girder and large openings are provided in the girder web which extend well below the bottom-most surface of the joist to better accommodate the routing of pipes, wiring, ventilation ducts and so forth above the bottom-most surface of the girders. Thus, the present invention provides a more vertically compact floor joist system than can be achieved by stacking the joists upon the girders, as previous floor joist systems require, thus allowing comparatively greater ceiling heights in rooms above or below the joists.

Normally, assembly of the floor joist system of the present invention would require only the simplest of hand tools for installation, including bending the compliant interconnecting pin and, in some cases, for drilling and/or bolting the spliced ends of abutting girders together. Furthermore, compared to wooden plank joists, the components of the inventive joist system are not so greatly influenced by commodity market prices and thus provide for more easily estimated construction costs.

The present invention provides a floor joist system comprising at least one girder having an upper flange surface and a web with vertical slots located therein, the girder supported at opposite ends, a plurality of joists having an upper flange surface and at least one tongue, two of the joist tongues being inserted into each girder slot from opposite sides of the girder web to form an overlapping relationship therein, each joist supported at opposite ends, the upper flange surfaces of the girder and joists being coplanar, and flooring attached to the girder and joist upper flange surfaces.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
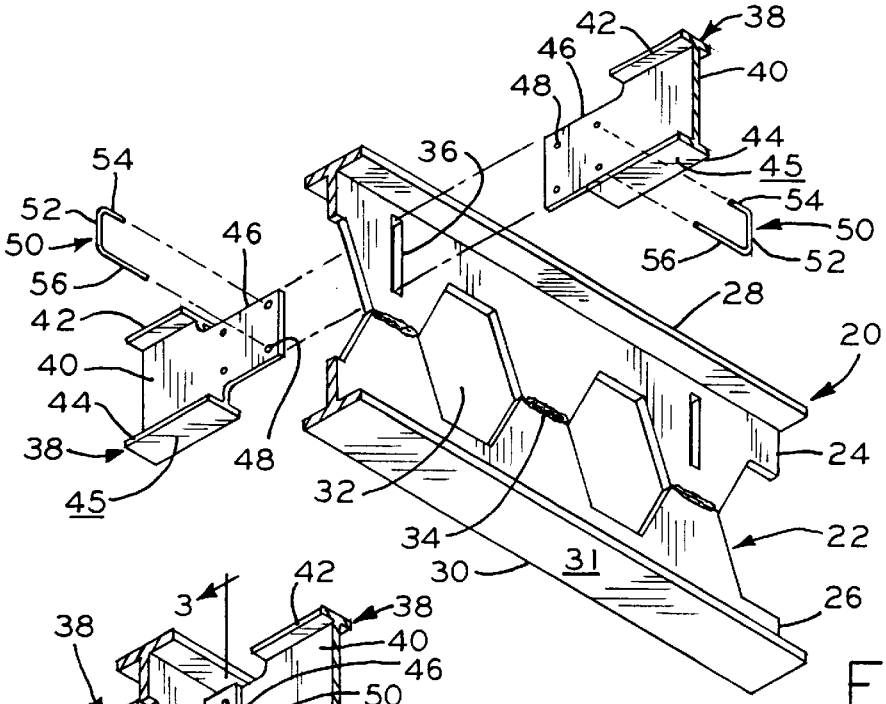
FIG. 1 is an exploded view from below illustrating the interconnection of a pair of opposed joists to a girder.
Figure 2:
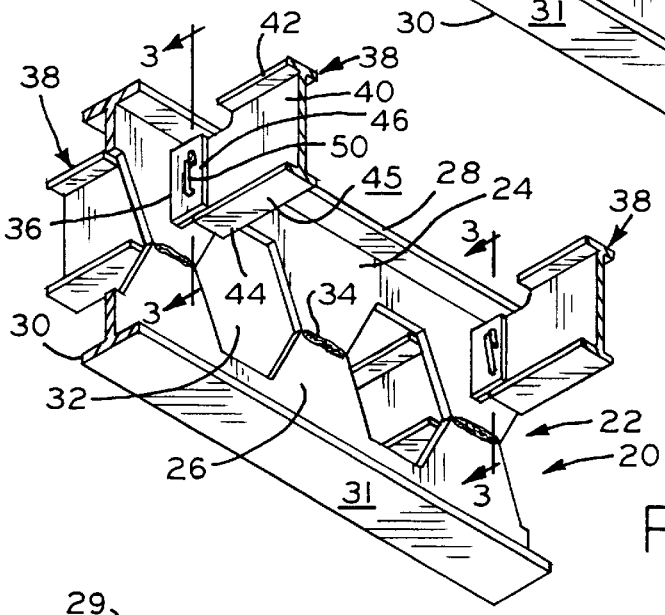
FIG. 2 is a perspective view from below of the assembled joists and girder of FIG. 1.

Corresponding reference characters indicate corresponding parts throughout the several views. Although the drawings represent one embodiment of the present invention, the drawings are not necessarily to scale and certain features may be exaggerated in order to better illustrate and explain the present invention. The exemplifications set out herein illustrate one embodiment of the invention such exemplification is not to be construed as limiting the scope of the invention in any manner.

DETAILED DESCRIPTION OF THE INVENTION

The embodiment disclosed below is not intended to be exhaustive or limit the invention to the precise form disclosed in the following detailed description. Rather, the embodiment is chosen and described so that others skilled in the art may utilize its teachings.

Referring now to the drawings and particularly to FIG. 1, the floor joist system of the present invention provides girder 20 which may be in the form of a castellated I beam having web 22 and upper and lower flanges 28 and 30, respectively. Web 22 is formed of upper and lower web portions 24 and 26, respectively, which, when joined at a plurality of welded joints 34, provide a plurality of large openings 32. Located between adjacent openings 32 and repetitively spaced at, for example, 24 inch increments along upper web portion 24 are formed vertical slots 36, which are cut through the web material. The dimensions and location of slots 36 will be further described below. Upper flange 28 has upper surface 29 and lower flange 30 has lower surface 31. In an embodiment of the present invention adapted to residential construction of ordinary type, the distance between surfaces 29 and 31 is approximately 12 inches. An example of a castellated beam of this approximate dimension, and into which slots 36 may be formed, is produced by Castellite and designated CB1215.

FIG. 1 further shows that girder 20 is intersected by I beam joists 38, each of which comprises web 40 and upper and lower flanges 42 and 44, respectively. Upper flange 42 has upper surface 43 and lower flange 44 has lower surface 45. The distance between surfaces 29 and 31 of girder 20 is substantially greater that the distance between surfaces 43 and 45 of joist 38. In an embodiment of the present invention adapted to residential construction of ordinary type, the distance between surfaces 43 and 45 is approximately 8 inches. Formed and extending from web 40 at each end of joist 38 is tongue 46 having a height substantially that of web 40 and equivalent thickness. Slot 36 is sized to slideably receive tongues 46 of two joists 38 in an easily yet closely fitting manner, tongues 46 entering slot 36 from opposite sides of girder web 22 and overlapping therein.

In embodiments of the present invention shown, four holes 48 arranged as two pairs of vertically aligned holes may be provided in each tongue 46. As tongues 46 of opposing joists are overlapped through slot 36, the leading pair of vertically aligned holes 48 in one tongue becomes superimposed on the trailing pair of holes 48 in the adjacent tongue, the leading pair and trailing pair of holes 48 in a given tongue located on opposite sides of girder web 22. Joist upper flange 42 may be cut away farther along web 40 than is joist lower flange 44 by a distance of approximately one half the width of girder upper flange 28 less one half the thickness of web upper portion 24, the resulting edge of flanges 42 and 44 lying in planes substantially perpendicular to web 40, such that joist tongue 46 is inserted into slot 36 until the edge of joist lower flange 44 abuts girder web 22 and the edge of joist upper flange 42 abuts the side of girder upper flange 28. By this means tongues 46 may be extended a consistent distance into slot 36, thereby aligning holes 48 in each.

Figure 3A:
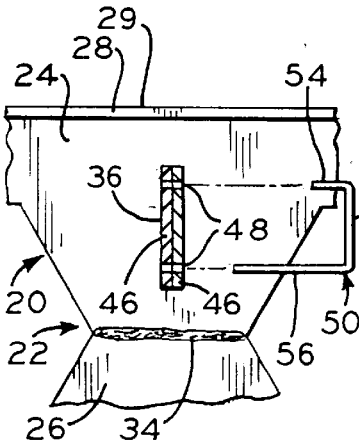
FIGS. 3A–3C are fragmentary sectional side views of the assembled girder and joist along line 3—3 of FIG. 2, showing the installation sequence of the interconnecting pin of one embodiment of the present invention.
Figure 3B:
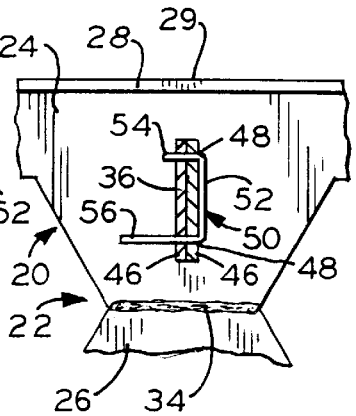
Figure 3C:
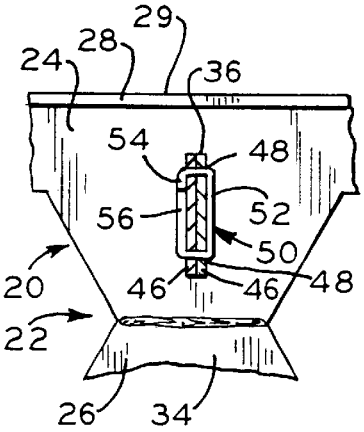

In embodiments shown, pin 50 may be of circular cross section and formed from a rod of compliant metal, such as aluminum or soft steel. Pin 50 is configured to provide central portion 52 having a length matching the distance between vertically aligned holes 48, from which extend perpendicularly thereto and in the same direction short leg 54 and long leg 56, best seen in FIG. 3A. Referring in sequence to FIGS. 3A–3C, pin 50 is inserted through aligned holes 48 on each side of girder web 22 such than central portion 52 lies alongside one of tongues 46, with short leg 54 and long leg 56 extending through aligned holes 48 (FIG. 3B). Short leg 54 and long leg 56 are bent towards each other using an appropriate, common tool such as a hammer. Pin 50 hence prevents relative movement of opposing joists 38 and positively interconnects them with girder 20, ensuring joists 38 do not come out of position during assembly of the floor joist system. Attachment of the subfloor to the upper flange surfaces of joists 38 and girder 20, discussed below, will permanently maintain the position of each joist. The use of pin 50 is but one way of maintaining the position of the joists during assembly; other suitable means are contemplated as being within the scope of the present invention. It should be noted that interconnecting joists 38 by the use of pins 50 or other suitable means is not a necessary aspect of practicing the present invention. Interconnecting the joist tongues as discussed above serves primarily to ensure joists 38 do not fall out of engagement with girder 20 during assembly of the floor joist system, providing an extra measure of safety for the workers. Once joists 38 have been fitted into an anchored girder and themselves anchored to the sidewall of the building or foundation, or fitted between adjacent, anchored girders, they are restrained from such accidental disengagement.

Figure 6A:
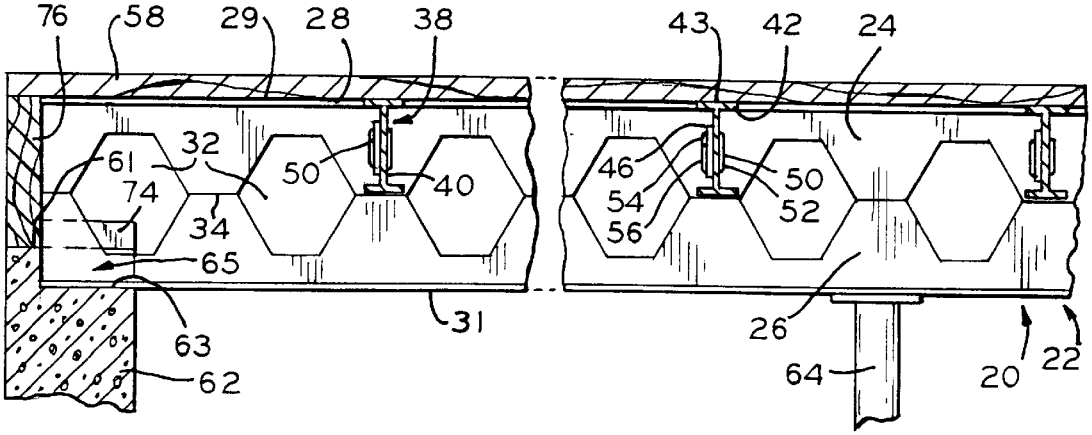
FIG. 6A is a fragmentary sectional side view of the floor joist system of the present invention along line 6—6 of FIG. 5, showing a supporting side wall and intermediate column.
Figure 6B:
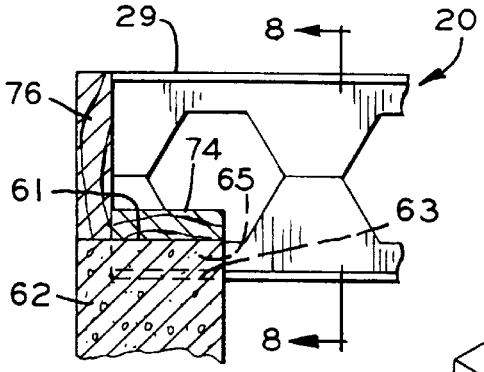
FIG. 6B is a fragmentary sectional side view of the floor joist system of FIG. 6A, taken along a line parallel to and to the right of line 6—6 of FIG. 5.
Figure 7A:
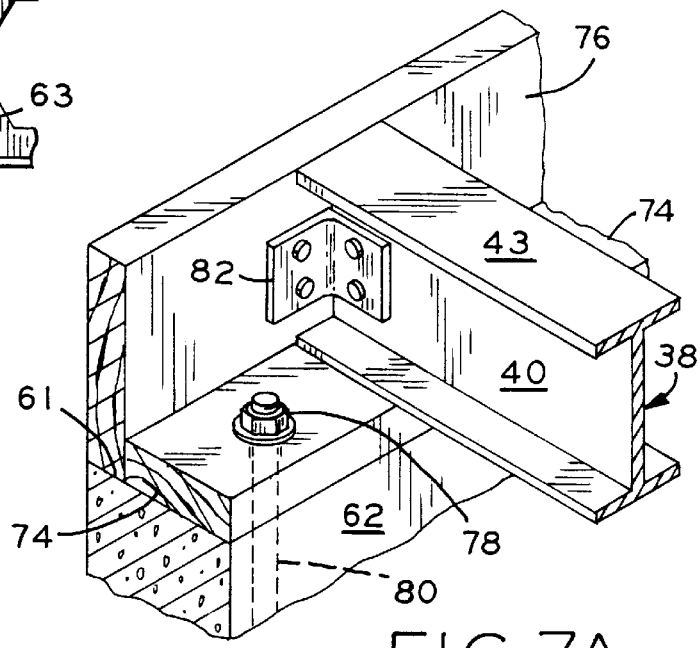
FIG. 7A is a perspective view from above of a joist and its supporting side wall, showing one method of anchoring a joist end to the side wall.

The ends of joists 38 which do not overlappingly engage another joist within girder slot 36 are supported by side walls 62 of the building or its foundation, depending upon whether multiples stories are accommodated, spaced therealong equidistantly and maintaining a perpendicular relationship between joist 38 and girder 20. Side walls 62 may form a perimeter around the building or its foundation. Below lower joist flange 44 and attached to top surface 61 of foundation side walls 62 is mud sill 74. Mud sill 74 extends along the inner perimeter of side wall top 61 is attached thereto in a known way, such as by nuts 78 threaded onto bolts 80 embedded in wall 62, spaced at specified distances along top 61, and which extend vertically through a hole in mud sill 74, as shown in FIG. 7A. Mud sill 74 may be a plurality of common 2 inch by 4 inch or 6 inch board or, where a 6 inch tall joist 38 is used with a 12 inch tall girder 20, a 4 inch by 4 inch wooden beam. As shown in FIGS. 6A–7B, rim joists 76, which may be a plurality of 2 inch by 10 inch boards, may extend around the perimeter of the building wall or foundation and are attached to mud sill 74 by nails or screws (not shown), closing off the uppermost interior of the below room from the exterior of the building.

Figure 7B:
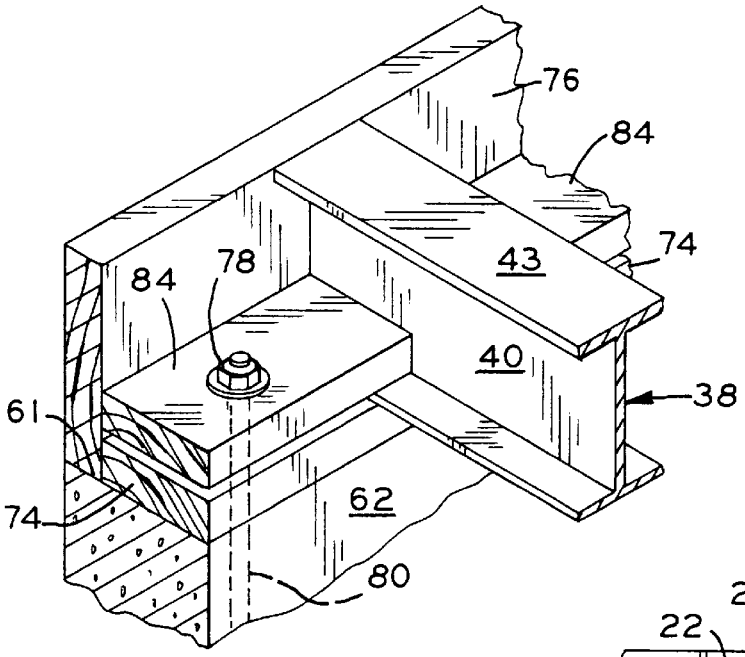
FIG. 7B is a perspective view from above showing an alternative to the method of anchoring a joist end to the side wall shown in FIG. 7A.
Figure 8:
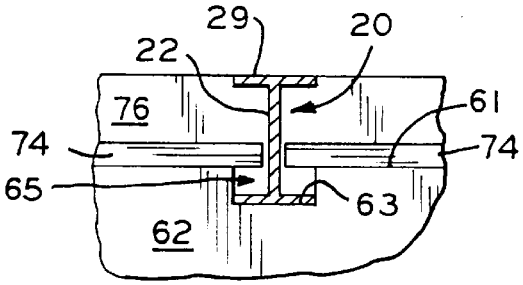
FIG. 8 is a sectional view along line 8—8 of FIG. 6B.

The ends of joists 38 supported by side wall 62 rest atop mud sill 74 and may be prevented from moving therealong by being bolted to rim joist 76 via angle brackets 82, as shown in FIG. 7A or, alternatively, by disposing blocks 84 between adjacent joists 38, as shown in FIG. 7B, the ends of blocks 84 abutting webs 40 of the joists. Blocks 84 are disposed above mud sill 74 and prevent movement of joists 38 therealong by at least one of blocks being fastened to wall 62 by bolt 80*a*, which extends through aligned holes in mud sill 74 and block 84. Nut 78 and bolt 80*a* hold fastened block 84 in place; the other blocks are restrained from moving longitudinally by joist webs 40. Blocks 84 may also be further secured by being nailed to mud sill 74. It is preferable that the end of joist 38 resting upon mud sill 74 do so upon its lower flange 44. Therefore, joists 38 which extend between side wall 62 and girder 20 may be preformed with tongue 46 at only one end thereof, and joists 38 which extend between adjacent girders 20 may be preformed with tongues 46 at both ends thereof. Alternatively, one joist design having tongue 46 at each end may be used, with tongue 46 cut off the joist end supported by side wall 62 as required. As seen in FIGS. 6A, 6B and 8, pockets 65 formed in adjacent side walls 62 support the ends of girder 20, the pockets providing a supporting surface 63 disposed below the top 61 of side wall 62 to accommodate the greater depth of girder 20 vis-a-vis joist 38, thus keeping girder upper flange surface 29 and joist upper flange surface 43 at a common level. The distance from the top of mud sill 74 to supporting pocket surface 63 is therefore equivalent to the difference in height between girder 20 and joist 38. Slot 36 is also vertically positioned such that when girder 20 and joist 38 are assembled, girder upper flange surface 29 and joist upper flange surface 43 lie in a common plane. As best seen in FIG. 8, web 22 of girder 20 is sandwiched between ends of the board comprising mud sill 74. Abutting the ends of mud sill 74 boards against web 22 further stabilizes girder 20 against falling over and, where pocket 65 is substantially wider than lower girder flange 30, positively positions girder 20 transversely.

Figure 4:
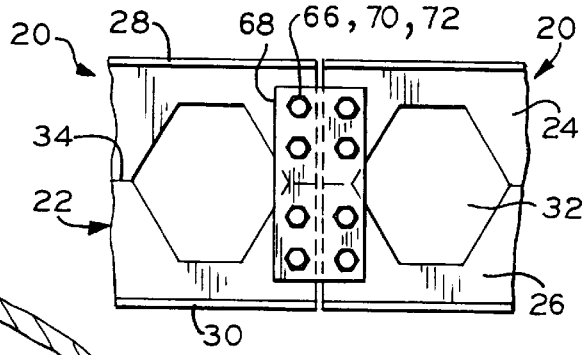
FIG. 4 is a fragmentary elevation showing a splice connecting two abutting girder ends.

In the above-described embodiment of the inventive floor joist system adapted to residential construction, the 8 inch high I-beam joists 38 spaced 32 inches on center may extend up to approximately 20 feet. In this case, therefore, pockets 65 provided in side walls 62 for girders 20 may be spaced at approximately 20 foot intervals from the adjacent side walls supporting an end of joists 38. To simplify assembly where joists 38 are to be fitted between two girders 20, the tongues 46 at the commonly oriented joist ends should be engaged into their mating slots 36 in the first girder before the second girder is moved into its final position. Girders 20 adapted to such use as described above may span up to approximately 18 feet between side walls or intermediate support columns 64 (FIG. 6A). Abutting or adjacently aligned girders 20 may be joined as shown in FIG. 4, where the adjacent ends of girders 20 have a series of splice holes 66, which may be preformed at both or only one end of each girder 20 or which may be drilled or otherwise formed in situ during construction. Splice plates 68, preferably formed of plate steel and having two sets of holes 70 arranged to match holes 66, are disposed on both sides of webs 22 of the adjacent girders 20 and fastened together through holes 66, 70 with bolts 72 and nuts (not shown). Support column 64 should be placed beneath a spliced girder joint to ensure the integrity of the floor joist system.

Figure 5:
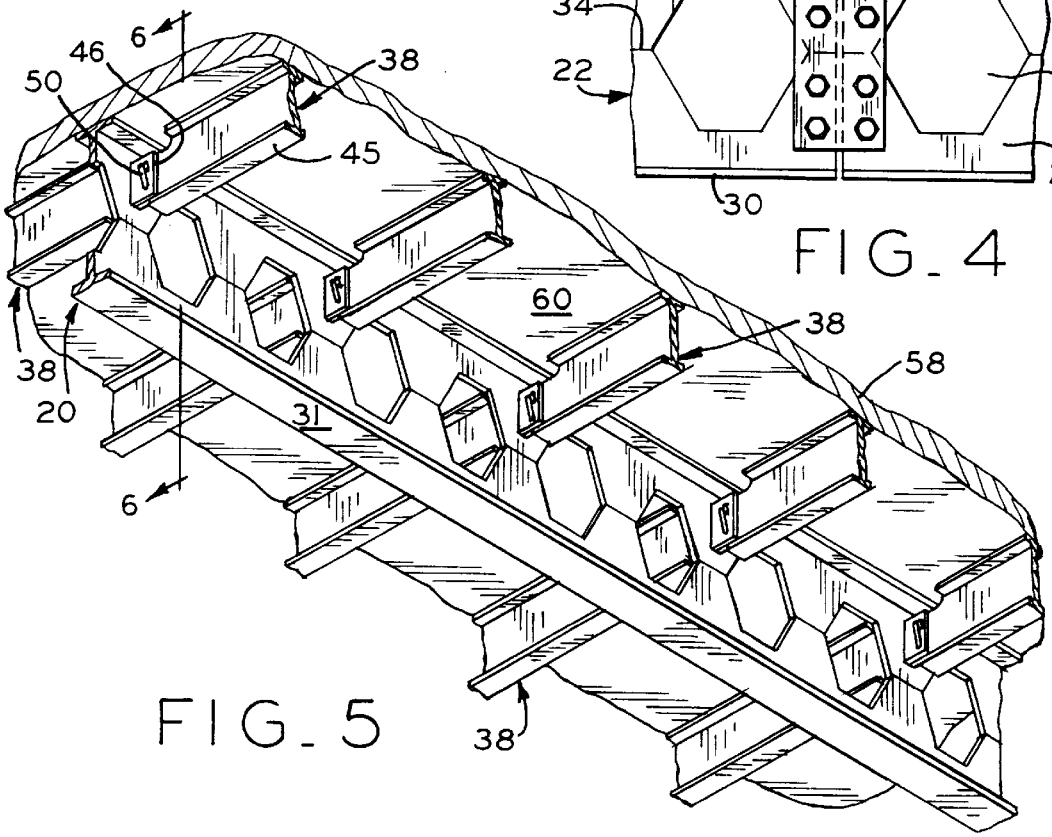
FIG. 5 is a fragmentary perspective view from below of the floor joist system of the present invention and the supported floor.
Figure 9:
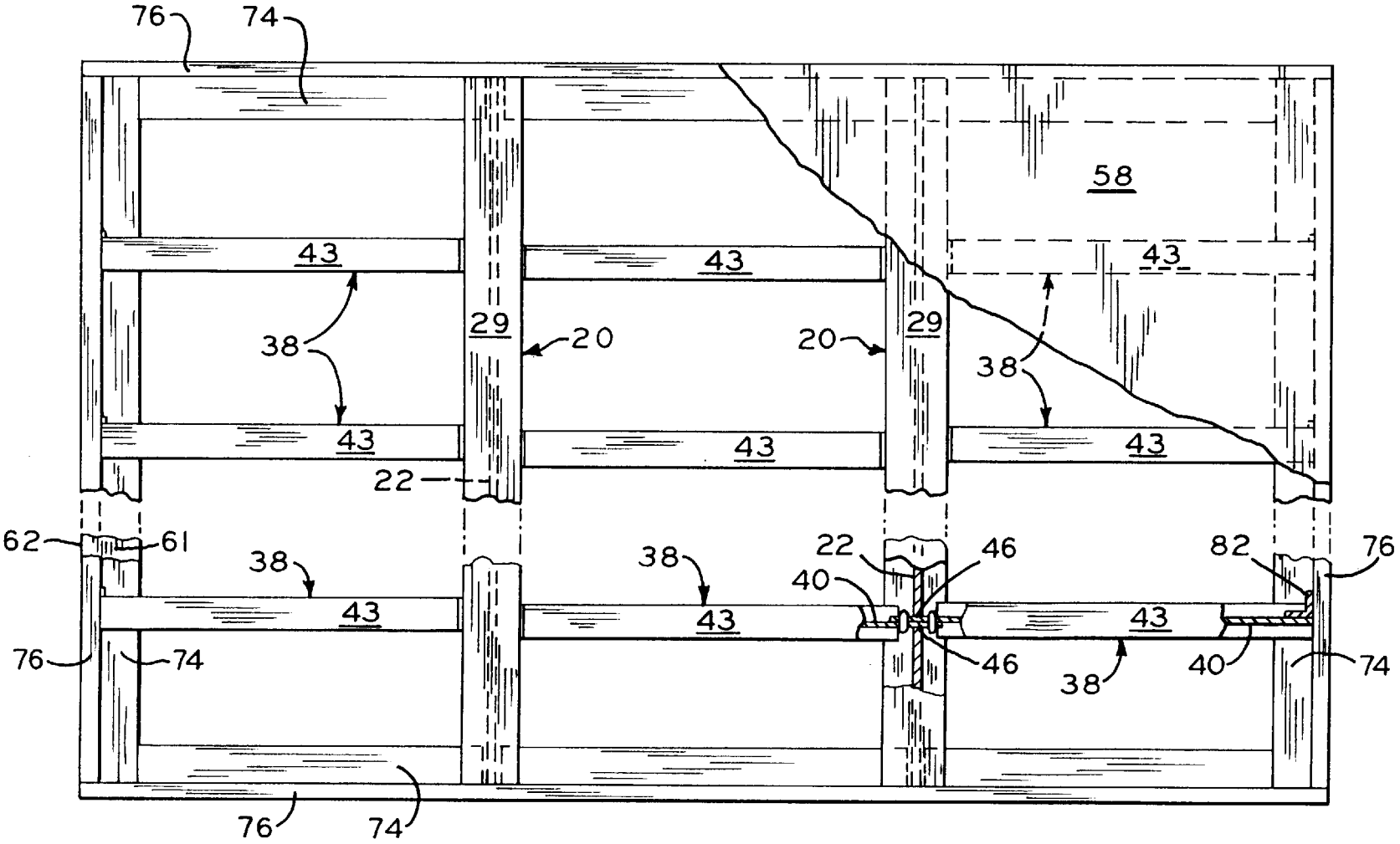
FIG. 9 is a plan view of the floor joist system of the present invention, showing a portion of the floor.

As shown in FIGS. 5 and 6, subfloor 58 is applied to the upper surfaces of the inventive joist system. Subfloor 58 may be plywood, as discussed above, or may comprise corrugated sheets of steel upon which concrete is poured. Generally, the latter type of floor is used in larger commercial building construction and may require girders 20 and joists 38 somewhat larger that described above, although such construction is to be considered within the scope of the present invention. Subfloor 58 is applied to the inventive floor joist system in commonly known ways. Generally, adhesive is first applied to upper flange surfaces 29 and 43 of girders 20 and joists 38, respectively, and the subfloor is then laid. Rather than using nails, however, drill point screws (not shown) are driven through the subfloor and into surfaces 29 and 43. Attachment of subfloor 58 to girders 20 and joists 38 permanently restricts movement of these beams. FIG. 9 shows an assembled floor joist system according to one embodiment of the present invention.

While this invention has been described as having an exemplary design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A floor joist system comprising at least one girder having an upper surface and a web with slots located therethrough, said girder supported at opposite ends, a plurality of joists having an upper surface and at least one tongue at one end thereof, each said joist supported at an opposite end thereof, two of said joist tongues inserted into each said girder slot from opposite sides of said girder web to form an overlapping relationship therein whereby said one end of said joist is supported by said girder, said upper surfaces of said joist and said girder being coplanar after insertion of said joist tongue into said girder slot, and flooring supported by said upper surfaces of said joist and said girder.

2. The floor joist system of claim 1, wherein said slots are vertical.

3. The floor joist system of claim 1, wherein each said joist tongue has at least one hole therein, said hole in one said overlapping joist tongue being substantially superimposed on said hole in the other said overlapping joist tongue, said joists interconnected through said substantially superimposed holes.

4. The floor joist system of claim 3, wherein said joists are interconnected by means of a fastener extending through said holes.

5. The floor joist system of claim 3, wherein each said joist tongue has at least one pair of vertically aligned holes therein, each said pair of holes in one said overlapping joist tongue being substantially superimposed on one said pair of holes in the other said overlapping joist tongue.

6. The floor joist system of claim 5, further comprising a pin, said pin comprising a center section and two legs, said legs received through said substantially superimposed holes.

7. The floor joist system of claim 6, wherein said legs are bent after being received through said holes to prevent removal of said pin.

8. The floor joist system of claim 5, wherein each said overlapping tongue has two pairs of vertically aligned holes, each said pair located on opposite sides of said girder web after said tongue is inserted into said girder slot.

9. The floor joist system of claim 5, further comprising a pin interconnecting said overlapping joist tongues, said pin received through each said pair of substantially superimposed holes.

10. The floor joist system of claim 1, wherein said girder web has a plurality of holes therein sized to accommodate wiring, piping and ducting.

11. The floor joist system of claim 10, wherein said girder comprises a castellated I beam.

12. The floor joist system of claim 1, wherein said joist comprises an I beam having a web, said tongues extending from said web.

13. The floor joist system of claim 12, wherein said tongues are formed from said I beam web.

14. The floor joist system of claim 12, wherein said I beam joist further comprises an upper flange and a lower flange, said girder further comprises an upper flange, said joist flanges being cut away such that said joist upper flange abuts the side of said girder upper flange and said joist lower flange abuts said girder web.

15. The floor joist system of claim 1, wherein said opposite ends of said joists are supported by a perimeter wall of a building.

16. The floor joist system of claim 15, wherein said joists are restrained longitudinally by said perimeter wall, whereby said tongues are held in their overlapping relationship.

17. The floor joist system of claim 15, wherein said girder opposite ends are supported by said perimeter wall.

* * * * *